US005971590A

United States Patent [19]

Nieminen et al.

[11] Patent Number: 5,971,590

[45] Date of Patent: Oct. 26, 1999

[54] METHOD FOR FETCHING HEADS FROM STACKS

[75] Inventors: Seppo Nieminen, Järvenpää; Aimo Ohtonen, Kerava, both of Finland

[73] Assignee: Valmet Corporation, Helsinki, Finland

[21] Appl. No.: 08/772,818

[22] Filed: Dec. 24, 1996

Related U.S. Application Data

[63] Continuation of application No. 08/193,952, Feb. 9, 1994, abandoned.

[30] Foreign Application Priority Data

Feb. 9, 1993 [FI] Finland ..... 930547

[51] Int. Cl.[6] ..... B65D 61/00

[52] U.S. Cl. ..... 364/478.01; 364/478.02; 414/801; 414/802; 53/136.2

[58] Field of Search ..... 901/35, 47; 414/797, 414/796.9, 796.5, 796.6, 796.7, 796.8, 797.1, 797.2, 797.3, 801, 802; 53/136.2; 364/478, 478.01, 478.02

[56] References Cited

U.S. PATENT DOCUMENTS

| | | | |
|---|---|---|---|
| 4,172,685 | 10/1979 | Nabeshima et al. | 414/139 |
| 4,339,904 | 7/1982 | Koutonen et al. | 53/136.2 |
| 4,363,585 | 12/1982 | Keller et al. | 212/286 |
| 4,723,884 | 2/1988 | Brinker et al. | 901/35 |
| 4,958,478 | 9/1990 | Hannen et al. . | |

FOREIGN PATENT DOCUMENTS

| | | | |
|---|---|---|---|
| 27234 | 2/1987 | Japan | 414/797 |
| 232184 | 9/1990 | Japan | 414/797 |

*Primary Examiner*—Thomas J. Brahan

*Attorney, Agent, or Firm*—Cohen, Pontani, Lieberman & Pavane

[57] ABSTRACT

In a method for manipulating paper roll heads by a multi-axis robot (8), heads are picked-up and transferred by the robot (8) from multiple stacks in accordance with stored data concerning the height and position of each stack as well as the dimension characteristics of the articles in the stack. At initial start-up, or immediately after a shut-down, previously stored information on the position or height of the stacks is considered not known by or otherwise unreliable by the robot (8) controller. That is, when the operation of the robot (8) is halted to accommodate replacement or replenishment of the head stacks, the stored parameter data for all stacks is set unknown. In accordance with its operating program, the system operation is restarted, the robot performs a slow-speed approach toward an uncalibrated stack, measures the stack data, that is, calibrates the stack height and position, and thus can perform the next stack approach through a normal transfer cycle on the basis of the measured data.

19 Claims, 2 Drawing Sheets

METHOD FOR FETCHING HEADS FROM STACKS

This is a continuation of application Ser. No. 08/193,952, filed Feb. 9, 1994, now abandoned.

BACKGROUND OF THE INVENTION

1. Field of the Invention

The present invention relates generally to article handling, and more particularly, to a method for picking up roll end header disks from a plurality of stacks using a multiple axis robot.

2. Description of the Prior Art

The finished product of the papermaking process is a continuously issued web approximately 6 meters wide. For shipment to customers and converters, the web is slit into a plurality of more manageable widths and wound into cylindrical reels or rolls of normally 1 to 2 meters in diameter. Shipment weights of such rolls may range from 1700 to 9200 pounds. To protect the finished rolls from damage during shipment and handling, they are typically wrapped with a heavy grade of paperboard having a thickness of 0.23 mm or greater.

The presently prevailing technique for such roll wrapping is to draw a strip of wrapping board from a supply reel of greater axial length than the roll to be protected. This web strip is wrapped tightly about the cylindrical surface of the protected roll. The axially overhanging portion is crimped radially inward toward the roll center and tightly creased against the circular roll end. To seal the roll end and hold the crimps down against the end faces, two circular header disks or "heads" of approximately the same diameter as the protected roll are used at each roll end-face. One head is inserted within the surface wrap overhang flush against the roll end-face. Adhesive, typically a hot-melt glue, is then applied to the outer face of this first or inner head. Next, the overhanging portion of the surface wrap is crimped and pleated into the inner head adhesive. Thereafter, a second header disk or "outer head" having adhesive applied to the inner face thereof is pressed against the outer face of the surface wrap pleats, thereby covering the crimped overlap of the wrapper and the inner head.

The inner head is usually relatively thick and thus capable of protecting the roll end against mechanical damage. The outer head, which serves to bind the wrapper at the roll ends and protect the roll from humidity, can be substantially thinner than the inner head. Frequently the coloring and printed pattern of the outer head are designed to give the roll a neat appearance.

Common to all prior art wrapping methods is the need for circular, usually die cut, heads of substantially the same diameter as the protected roll. If several different diameter sizes are prepared for shipment by the producing mill, it is necessary to make, or purchase and store, such respectively sized heads preparatory to use. Prior to wrapping, the width and diameter of the roll to be protected is measured, and heads of suitable diameter and width are selected from this group for placement on the roll ends.

The end heads can be placed on the roll ends in a variety of ways. Manual placement of the heads is the oldest method, and it is still suited for relatively small capacity wrapping lines or applications not requiring a substantial degree of automation. In accordance with the manual technique, the operator positions the appropriate inner heads manually on the roll ends. The operator then places the corresponding outer heads onto heated press platens, which platens press the outer heads into adherence with the roll ends. The inner heads are kept against the roll ends by means of separate arms for the duration of the crimping of the wrapper overlaps against the roll ends. The adherence of the outer heads to the platens during the operation is achieved using vacuum. In order to overcome the processing speed limitations on the manual technique described above, various types of automatic heading machines have also been utilized. A common feature of almost all such conventional automated heading devices is that, for each end of the roll, a separate heading machine with an associated head clamp is provided. The head clamp transfers the head from the head stack or stacks to a corresponding roll end.

In one conventional heading device, a rotatable arm is mounted on a vertical guide, the arm having at its distal end a rotatable vacuum clamp for grasping the heads. This type of heading machine is typically employed in conjunction with different kinds of head storage shelves situated beside the heading machine. Using this machine, the heads are placed on the roll ends so that the support arm of the clamp is transferred along a vertical guide to the level of the shelf containing the correctly sized heads. Next, the support arm of the clamp and the heading machine itself are rotated until the clamp is aligned parallel with the shelf. Thereafter, the head is gripped and transferred from the shelf to the roll end by rotating both the support arm of the clamp and the heading machine and moving the heading machine along the guide.

In another type of known automated heading machine, the heads are placed in stacks on the factory floor and then transferred therefrom to the roll ends by means of an overhead gripping device, typically a carriage mounted manipulator. The gantry transfer carriage of this device is constructed above the stacks of heads and the heading manipulators are generally movable along a single, crosswise movable rail. Thus, a separate stack of heads of a predetermined size must be provided for each heading manipulator.

A major disadvantage of the prior art automated heading systems discussed above is that a separate heading manipulator and a dedicated head storage shelf or supply stack is required for each roll end. The heading machines employed are of a special-purpose configuration in that they are designed for manipulating heads only and their associated control software must be tailored particularly for a particular operating environment. Accordingly, modifications to the operation of the system are cumbersome and require specialized design capabilities.

In addition to the known techniques discussed above, it would also be possible to manipulate the heads using a standard multiple axis robot. Such a robot, for example, could be integrated with the layout of a wrapping line in a manner permitting the robot to pick up and place a head on each end of the roll or onto a press platen. To obviate the need for two separate head transferring cycles, it would be particularly desirable to configure such a robot with a two sided clamp capable of a flipping movement by which both roll ends could be sequentially gripped and both heads simultaneously transferred to the roll during a single transfer cycle.

When retrieving the outer heads from respective stacks utilizing a robot, certain information must be known in order to optimize the processing speed of the transfer operation. The location of the stacks must be known so as to allow direct picking up of the heads without requiring that a stack location determination be made during each head transfer cycle. Another reason why stack position must be known is that the clamp carried by the arm of the robot must grasp the head by a predetermined point to ensure correct positioning of the head upon release. Another item of information which must be utilized by the robot control software to achieve an efficient transfer operation is the height of each stack. Specifically, if the height of a stack is known, the clamp can be immediately moved to a pick-up position relative to the uppermost head of the stack so that incremental clamp position adjustments or "inching steps" for finding the top of the stack are unnecessary.

Accurate placement of head stacks relative to a robotic gripping device can not be achieved without unwieldy special arrangements, principally because the stacks are brought into place by fork-lift or other transfer means unsuitable for such placement. Consequently, the actual position of the stack subsequent to replenishment or replacement must be reported in some manner to the control software. The reporting can be manually performed at start-up or after stack replenishment, for example, by requiring the wrapping station operator to update information concerning the heads of the replenished stacks as well as the height and position of the stacks using a data terminal keyboard. Such a manual procedure, however, is awkward, inefficient, and possibly dangerous. To enter the stack height and location accurately requires a sufficiently accurate method of measuring such dimensions. The measurement cycle increases the system downtime consumed by the stack replenishment operation and introduces several error sources. Moreover, the robot control software is incapable of distinguishing between accurate and inaccurate information. Thus, if the wrapping station operator, due to stress or other reasons, were to enter incorrect measurement data to the control system or completely neglect to enter the altered measurements of a stack, the robot would perform the head transfer cycle on the basis of the incorrect or outdated information and possibly invoke extremely serious hazards. In the least severe cases, the head transfer cycle fails or the head is incorrectly positioned relative to the roll, whereby the error may be immediately detected and corrected. In the most serious case, the robot can topple or move the stack, or even cause damage to itself or other structures. In any event, operation of the wrapping station must be halted until a fault situation can be rectified.

It is therefore an object of the present invention to provide a method in which the robot is controlled in accordance with a program which autonomously calibrates the position and height of the stacks, thus avoiding the problems and disadvantages discussed above.

SUMMARY OF THE INVENTION

It is therefore object of the present invention to provide a method through which the robot software can autonomously calibrate the position and height of the stacks, thus avoiding the fault situations described above.

The invention is based on the principle of resetting all stack parameter data if the robot operations is halted during, e.g., the replenishment of the head stacks.

At the restart of the operation, the robot performs a slow-speed approach including measurement steps to any uncalibrated stack thus measuring the stack height and position, while during the next head pick-up cycle the approach is made at normal speed on the basis of the measured information.

The principal benefit of the method is the inherently safe operation of the heading system. As the number of human errors is minimized and the system operation is highly systematic, the possibilities of error are minimal. The measurements related to the calibration of stack heights and positions cause almost no impediment of system operating speed. The method is safe, because its operation is essentially based on the principle that when the operator poses a request to enter the robot's danger zone to replenish the stack, the robot is controlled to the home position and is allowed to continue its operation only after receiving a clearing message of the danger zone. Due to the position calibrating steps, good accuracy in the placing of the heads is attained, and the position and height of the stacks can be periodically verified based on, e.g., the number of head removals performed from a certain stack. Such verification is necessary as the stacks are not generally entirely straight. The method can be applied without performing major structural or software changes thus making it suitable for all standard types of industrial robots.

The various features of novelty which characterize the invention are pointed out with particularity in the claims annexed to and forming a part of the disclosure. For a better understanding of the invention, its operating advantages, and specific object attained by its use, reference should be had to the drawings and descriptive matter in which there are illustrated and described preferred embodiments of the invention.

BRIEF DESCRIPTION OF THE DRAWINGS

A better understanding of the present invention will be facilitated by reference to the detailed description below in combination with the annexed drawings in which.

DESCRIPTION OF THE PREFERRED EMBODIMENTS

Figure 1:
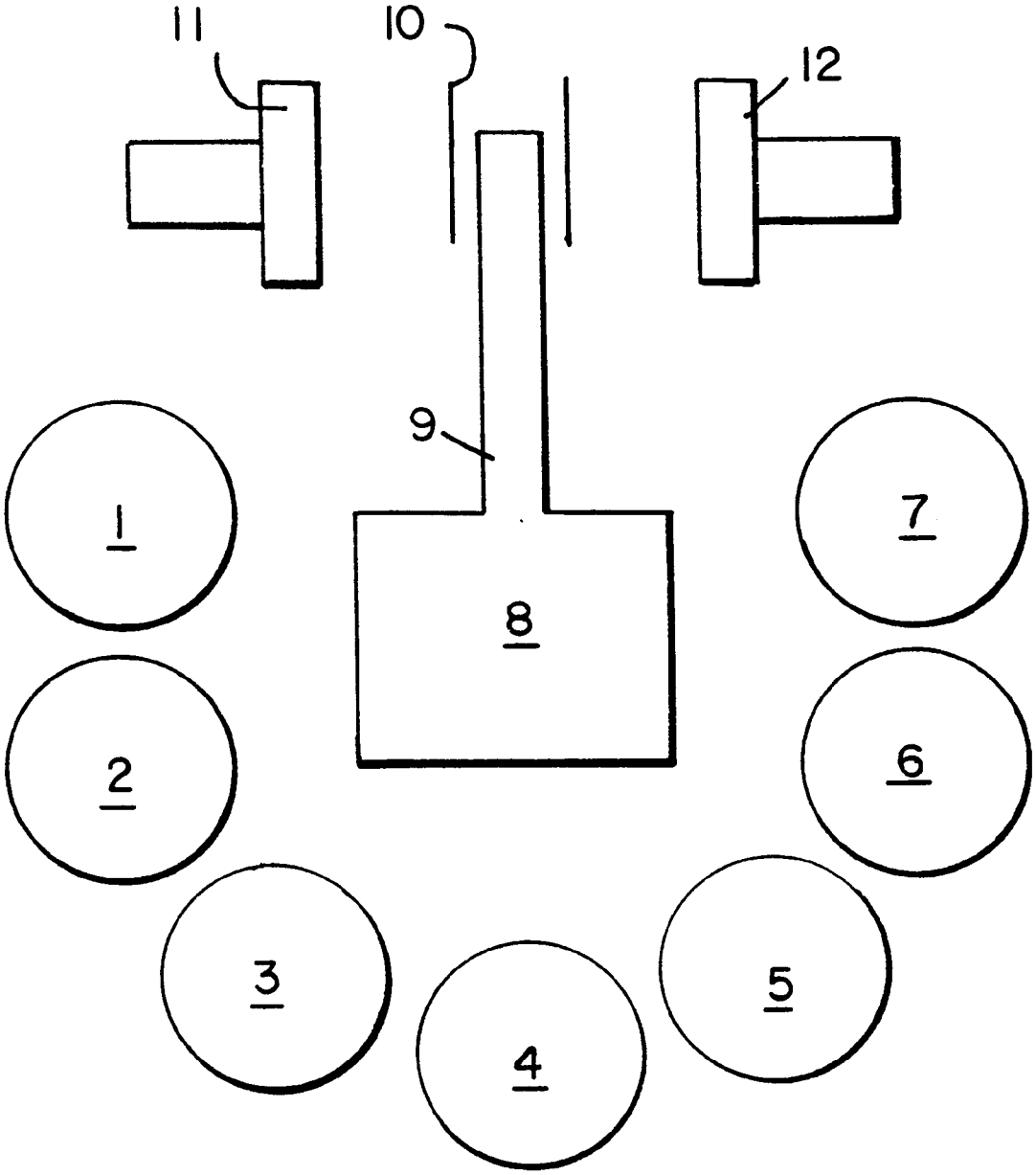
FIG. 1 depicts an arrangement of a multiple-axis robot relative to a plurality of stacked roll-end heads and a press platen suitable for use in performing the method of the present invention.
Figure 2:
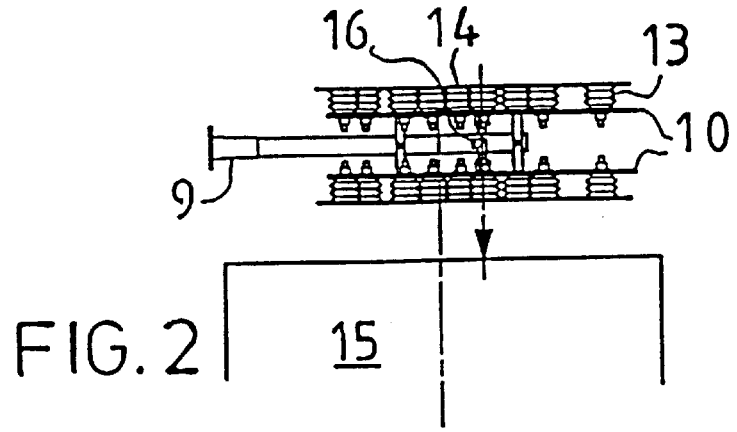
FIGS. 2–4 show the sequence of clamp movements in accordance with a measuring step of the present invention.

When a multi-axis robot 8 is used for transferring the heads, it is preferably positioned so that the rotational center of the robot is coincident with the symmetry axis of the wrapping station/press platen unit. From this position, the heads are easy to move to the roll ends or press platens 11, 12. With reference to FIG. 1, the robot 8 is positioned in the abovementioned manner on the symmetry axis of the press platens 11, 12. Then, the head stacks 1–7 are grouped to form a semi-circular or "C" arrangement as shown in the diagram, or alternatively, a "U"-shaped pattern about the robot. The entire piling area shown in the diagram is surrounded by a protective fence which prevents access to the working envelope of the robot 8. During the operation of the robot 8, the heads are picked up from a stack in accordance with the diameter of the roll to be wrapped, by means of a clamp 10 mounted to the end of the arm 9 of the robot 8, and are subsequently transferred to respective press platens 11, 12. Although any suitable clamping structure may be utilized, a clamp capable of gripping and simultaneously transferring two heads is preferred to avoid the need for separate transfer cycles for each end of the roll being wrapped. The clamp 10 employed can be configured, for example, as a two-sided clamp, such as the one shown in FIGS. 2–4. As best shown in FIG. 2, each side of the clamp includes a base plate 10 having mounted thereon a plurality of resilient suction cups 13. The outer rims of the suction cups 13 collectively define a suction plane 14. Reference numeral 16 in the diagram indicates a sensing means utilized for position calibration, and reference numeral 15 indicates a head stack. In the illustrative embodiment, sensing means 16 is a single photocell. At startup of the system, the robot control operates in accordance with a control program routine in which the exact height and position information for all stacks 1–7 is assumed to be unknown. However, if the system operation is interrupted in a situation in which the software of the robot 8 possesses valid information of such stack height and position data, the operation is continued from the situation in which the system was stopped. In a situation of having the stack heights set as unknown, the robot 8 measures the height and position of the stack as it for the first time removes a head from each unknown stack. In this context the term unknown stack refers to a stack whose height and position are not yet stored in memory in accordance with the control. The stack data is always reset to an unknown condition when the robot operation is halted for any reason. A halt in this context refers to all system states causing the robot to stop, with the exception of a controlled stop, such as a work shift not involving a replenishment of any stack. In the case of a controlled stop, the latest updated information on the stacks is retained in memory for continued use by the control program. In practice the stack data are preferably always reset unknown for reasons of safety, irrespective of the reason for interrupting robot operation.

The pick-up cycle of the heads and their transfer to the roll ends or onto the press platens occurs so that the sensor station of the wrapping line instructs the robot 8 as to the size and type of head required. Then, the robot 8 picks up the proper heads by means of two-sided clamp 10 from the correct stack and transfers them onto press platens 11, 12. If the heights and positions of the stacks are known, the robot 8 transfers the clamp 10 by a high-speed movement to the uppermost position above the stack 15. Only the vertical picking up movements of the head are performed using the slow inching speed. Thus, the pick-up cycle of the heads can be implemented in an extremely short time.

When the stacks 1–7 are desired to be replenished, moved or otherwise changed, the operation is as follows. The station operator informs the robot controller of a need to enter the robot's danger zone or work envelope. Then, the robot finishes a possible uncompleted transfer cycle, drives itself to predetermined position and assumes a safety state, after which the interlocks of the danger zone are deactivated and switched off. Next, the station operator can open the safety gate to the danger zone and enter the danger zone to change and/or replenish the head stacks. After the operator has left the danger zone, closed the safety gate and reinstated the integrity of the danger zone, the height and position data for all stacks are reset unknown. The robot then continues the manipulation of the heads in a programmed manner though performing its initial approach to any unknown stack in accordance with an incremental approach and measurement cycle.

The given unknown approach to an unknown stack takes place so that the presumed pick-up height at a stack 15 is set equal to the maximum height associated with the stack plus a preset constant. The clamp 10 is thus transferred by a high-speed movement above the stack 15 to a level equal to the maximum height of the stack plus the preset constant wherefrom the aforementioned incremental slow-speed approach is commenced. The maximum travel of the clamp 10 from the starting height is limited to a constant length. When the upper surface of the stack 15 is detected by means of photocell 16, the system either chooses to verify the position of the stack 15, or alternatively, sets the linear speed of the clamp to a still slower inching speed of the picking step, and the remaining travel is set equal to the computed travel to the surface of the stack 15 or even slightly below the upper surface. The movement is stopped when a contact with the surface of the stack 15 is indicated by a mechanical sensor such as a limit switch (not shown), and this measured position is stored as the stack height. In the event that photocell 16 cannot detect the surface of the stack 15 within the constant maximum approach travel distance, that is, the stack height is less than the stack maximum height, a new approach length is allocated for the travel of the clamp 10 and the approach cycle is repeated. This cycle can be repeated until the upper surface of the stack 15 is detected, or alternatively, a preset minimum stack height is reached, whereby a message indicating a depleted stack is issued and a stack replenishment is requested.

After the height of the stack 15 has been measured, the deviation of the stack position relative to a predetermined location stored in memory is measured. Each stack has a preset position where the stack should be placed. During the above-described incremental approach cycle, the clamp 10 is controlled above the stack to the point where head pick-up should occur for a correctly placed stack. Consequently, after the stack height is measured, the clamp remains in the position relative to the stack where the head could be picked up from a correctly placed stack. Next, the position of the stack 15 is calibrated via a sequence in which the clamp 10 is elevated slightly above the head surface and transferred toward the stack edge; in practice, this is performed as soon as the photocell detects the upper surface of the stack 15. The transfer takes place along the symmetry axis of the head stack. By definition, the symmetry axis of the head stack is the line passing through the center point of the stack and being aligned equidistant from the stacks immediately adjacent to the stack being measured. Each head diameter is assigned a preset transfer distance X extending from the initial position of the clamp 10 to the edge of the head stack 15. As is evident from FIG. 2, the transfer distance X is equal to the distance of the photocell 16 of the clamp 10 from the edge of a correctly placed head stack 15. While the mounting position of the photocell 16, and thus the distance X, can be selected freely, the mounting position is advantageously selected, such transfer movement occurs over the symmetry axis K of the head stack, whereby the position of the clamp 10 relative to the head stack need not be altered for small-diameter stacks. The transfer movement is preferably always performed as accurately as possible radially over the head.

Figure 3:
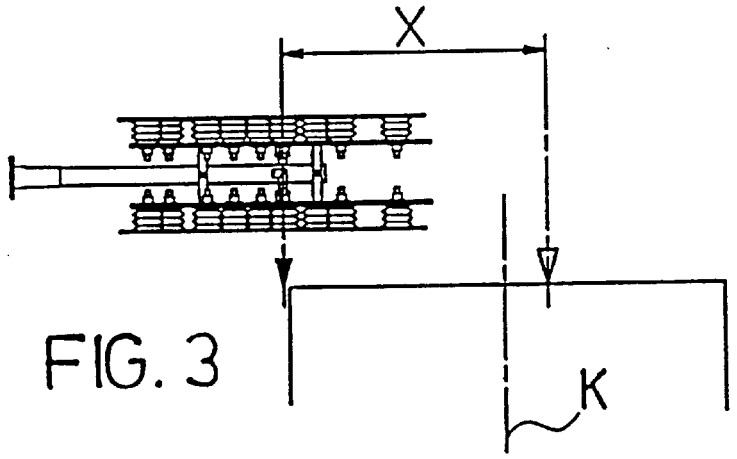
Figure 4:
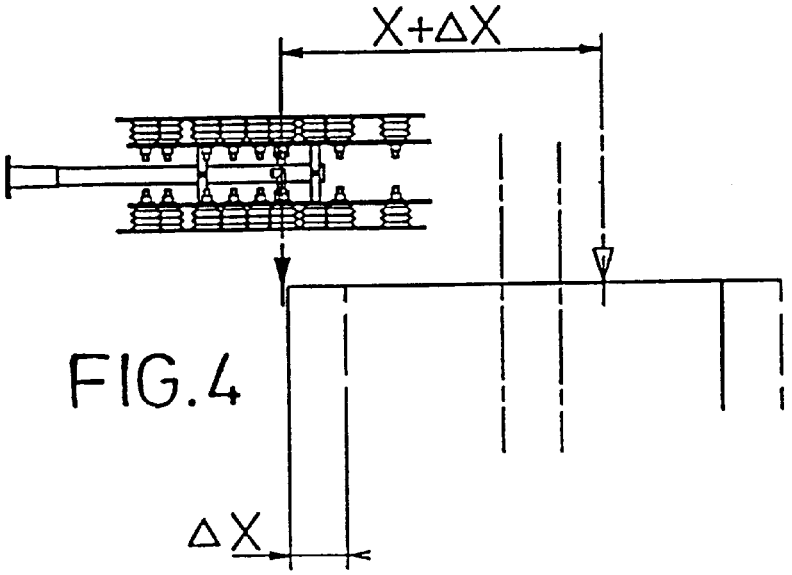

During the transfer movement X, the photocell 16 detects the edge of the head stack. In FIG. 3 the edge of the stack 15 is shown correctly placed, whereby the stack position can be stored as the preset position into the memory of the robot 8. By contrast, the position of the stack 15 in FIG. 4 is shown to be farther from the starting point of the measurement than the dimension X, whereby by stack position is set equal to (preset value(X) $+\Delta X$). Correspondingly, if the stack edge is detected before the clamp 10 has been transferred by the distance X, the stack position is set equal to (preset value (X)$-\Delta X$). When the heads are being picked-up during the next transfer cycle from the stack, the clamp can thus be directly controlled to the corrected pick-up position.

The stack position measurement is performed in the radial direction alone, that is, along the axis aligned essentially radial relative to the rotational center of the robot 8. Lateral measurement of the stacks is not necessary in practice, since the stacks are so close in this direction that a major displacement hardly can occur. If desired, however, an additional sensor can be used to implement stack position calibration in the lateral direction, as well.

After both the height and position data of the stack are stored into the memory of the robot 8, the height and position of the stack are now known and the next head can be picked-up directly from the calibrated position of the measured stack without resorting to the slower incremental approach step. All other stacks are calibrated in a similar manner when heads are picked-up from them for the first time. Thus, no separate measurement cycle for all stacks is needed prior to the start of the actual heading operation.

The position and height of the stacks 1–7 is calibrated at preset intervals. Each head stack and type can be assigned a proper number of pick-up cycles after which the height and position of the stack are again measured in accordance with the slow, incremental approach. The essential purpose of the calibration measurement is to update the stack position information, since the stacks are often sideways skewed, whereby the coordinates of the stack top change as the stack height is lowered after successive head transfer cycles. The calibration cycle is also performed after fault situations. As the software executed by the controller of robot 8 can obtain accurate stack position and height information where needed, the number of operating and heading errors is significantly reduced.

Besides those described above, the present invention can have alternative embodiments.

In the above-described embodiment the sensor instrumentation of the clamp was implemented by means of mechanical and optical sensors. For the method according to the invention, however, the arrangement and types of sensors employed has no relevance, thus permitting the sensor instrumentation to be solved in any desired manner. The measurement order in the calibration of stack position and height data can be interchanged, while such change may complicate the detection of the stack edge if the stack is appreciably lower than the preset maximum height of the stack. In the measurement of the stack position, the direction of the transfer movement X can be opposite to that described above, and when necessary, also the lateral position of the head stack can be calibrated. The above-described embodiment performs calibration on two stack coordinates, namely the stack height plus the stack position in one direction, and both stack parameters are reset to unknown at the occurrence of a system halt. Besides these, the stack data update can include stack position calibration in some other direction, possibly also identification of the head type contained in the stack, whereby different types of heads can be placed in the stack without entering prior information to the robot software. To achieve identification of head type or grade, however, a head ID code and compatible code reader are required.

The invention is not limited by the embodiments described above which are presented as examples only but can be modified in various ways within the scope of protection defined by the appended claims.

What is claimed is:

1. A method for transferring heads for paper rolls from a stack of heads to a placement location, the stack and the placement location being within an operating range of a multi-axis robot, the robot having an arm adapted to remove a head from the stack and being interactively connected to a memory device for storing data and for controlling operation of the robot, comprising:

transferring the heads from a plurality of stacks of heads to the placement location, the stacks of heads being positioned within the operating range of the robot in a semi-circular line about the robot;

storing data in the memory device relating to physical characteristics of the stack and the heads therein;

moving the arm in a first operating mode into a head pick-up location relative to the stack in accordance with the data in the memory device, removing a head from the stack using the arm, and using the arm to transfer the removed head to the placement location;

interrupting the first operating mode of the arm to effect replacement to the stack of removed heads and deleting a portion of the data stored in the memory device in said storing step relating to a portion of the physical characteristics of the stack and the heads therein;

subsequent to said interrupting step and replacement of removed heads, moving the arm in a second operating mode into the head pick-up location relative to the stack, acquiring at least one measurement of the physical characteristics of the stack and the heads therein, removing a head from the stack using the arm, using the arm to transfer the removed head to the placement location, and updating the data in the memory device in accordance with the measurement acquired in said second operating mode; and after completion of the second operating mode, moving the arm in accordance with the first operating mode.

2. The method according to claim 1, wherein data stored during said storing step includes stack height and wherein stack height is measured during said second operating mode.

3. The method according to claim 2, wherein data stored during said storing step includes stack position and wherein stack position is measured during said second operating mode.

4. The method according to claim 2, where said interrupting step further includes resetting the data stored in the memory device relating to the stack height to a predetermined maximum height value, and wherein said second operating mode includes:

positioning the arm proximate the stack at a predetermined distance above the predetermined maximum height; and lowering the arm toward the stack.

5. The method according to claim 4, wherein the arm is lowered at a lowering speed during said lowering step in a fast-speed mode until proximity of an upper surface of the stack is detected by a first sensing means disposed on the arm and in a slow-speed mode thereafter, the lowering speed of the arm in the fast-speed mode being greater than the lowering speed of the arm in the slow-speed mode.

6. The method according to claim 5, wherein the arm is lowered in said slow-speed mode until the upper surface of the stack is sensed by a second sensing means disposed on the arm, said second sensing means providing a stack height measurement for the updating step.

7. The method according to claim 5, wherein the arm is lowered in said slow-speed mode until the arm has been lowered by the predetermined distance.

8. The method according to claim 7, further comprising lowering the arm in predetermined distance increments after lowering the predetermined distance until the arm reaches a position corresponding to a predetermined minimum stack height.

9. The method according to claim 1, wherein data stored during said storing step includes stack position and wherein stack position is measured during said second operating mode.

10. The method according to claim 1, wherein the first operating mode further comprises periodically acquiring at least one measurement of the physical characteristics of the stack and the heads therein and updating the data in the memory device in accordance with the measurement acquired in the first operating mode.

11. A method for transferring heads for paper rolls from a stack of heads to a placement location, the stack and the placement location being within an operating range of a multi-axis robot, the robot having an arm adapted to remove a head from the stack and being interactively connected to a memory device for storing data and for controlling operation of the robot, comprising:

(a) storing data in the memory device relating to physical characteristics of the stack and the heads therein, including stack position;

(b) moving the arm in a first operating mode into a head pick-up location relative to the stack in accordance with the data in the memory device, removing a head from the stack using the arm, and using the arm to transfer the removed head to the placement location;

(c) interrupting the first operating mode of the arm to effect replacement to the stack of removed heads and deleting a portion of the data stored in the memory device in said storing step relating to a portion of the physical characteristics of the stack and the heads therein, including resetting the data stored in the memory device relating to the stack position to a predetermined initial pick-up positions;

(d) subsequent to said interrupting step and replacement of removed heads, moving the arm in a second operating mode into the head pick-up location relative to the stack, acquiring at least one measurement of the physical characteristics of the stack and the heads therein, including stack position, removing a head from the stack using the arm, using the arm to transfer the removed head to the placement location, and updating the data in the memory device in accordance with the measurement acquired in said second operating mode, said second operating mode including the steps of:

moving the arm into the initial pick-up position;

moving the arm radially with respect to the stack until an edge thereof is detected by a sensing means disposed on the arm;

determining a difference between the initial pick-up position and the detected edge; and updating data stored in the memory device using the difference; and (e) after completion of the second operating mode, moving the arm in accordance with the first operating mode.

12. The method according to claim 11, wherein the heads are transferred from a plurality of stacks of heads to the placement location, and the stacks of heads are positioned within the operating range of the robot in a semi-circular line about the robot.

13. The method according to claim 11, wherein data stored during said storing step includes stack height and wherein stack height is measured during said second operating mode.

14. The method according to claim 13, where said interrupting step further includes resetting the data stored in the memory device relating to the stack height to a predetermined maximum height value, and wherein said second operating mode includes:

positioning the arm proximate the stack at a predetermined distance above the predetermined maximum height; and lowering the arm toward the stack.

15. The method according to claim 14, wherein the arm is lowered at a lowering speed during said lowering step in a fast-speed mode until proximity of an upper surface of the stack is detected by a first sensing means disposed on the arm and in a slow-speed mode thereafter, the lowering speed of the arm in the fast-speed mode being greater than the lowering speed of the arm in the slow-speed mode.

16. The method according to claim 15, wherein the arm is lowered in said slow-speed mode until the upper surface of the stack is sensed by a second sensing means disposed on the arm, said second sensing means providing a stack height measurement for the updating step.

17. The method according to claim 15, wherein the arm is lowered in said slow-speed mode until the arm has been lowered by the predetermined distance.

18. The method according to claim 17, further comprising lowering the arm in predetermined distance increments after lowering the predetermined distance until the arm reaches a position corresponding to a predetermined minimum stack height.

19. The method according to claim 11, wherein the first operating mode further comprises periodically acquiring at least one measurement of the physical characteristics of the stack and the heads therein and updating the data in the memory device in accordance with the measurement acquired in the first operating mode.

* * * * *